US010624478B2

(12) United States Patent
Kane

(10) Patent No.: US 10,624,478 B2
(45) Date of Patent: Apr. 21, 2020

(54) CONTAINER AND ATTACHMENTS THEREFOR

(71) Applicant: Sharon Kane, Glasgow (GB)

(72) Inventor: Sharon Kane, Glasgow (GB)

( * ) Notice: Subject to any disclaimer, the term of this patent is extended or adjusted under 35 U.S.C. 154(b) by 125 days.

(21) Appl. No.: 14/654,684

(22) PCT Filed: Dec. 23, 2013

(86) PCT No.: PCT/GB2013/053414
§ 371 (c)(1),
(2) Date: Jun. 22, 2015

(87) PCT Pub. No.: WO2014/096869
PCT Pub. Date: Jun. 26, 2014

(65) Prior Publication Data

US 2015/0313388 A1 Nov. 5, 2015

(30) Foreign Application Priority Data

Dec. 21, 2012 (GB) ..... 1223231.0

(51) Int. Cl.

| | |
|---|---|
| ***A47G 19/22*** | (2006.01) |
| ***B65D 1/02*** | (2006.01) |
| ***B65D 47/06*** | (2006.01) |
| ***B65D 47/12*** | (2006.01) |
| ***B65D 8/00*** | (2006.01) |

(52) U.S. Cl.
CPC ..... *A47G 19/2266* (2013.01); *B65D 1/0207* (2013.01); *B65D 15/02* (2013.01); *B65D 47/06* (2013.01); *B65D 47/12* (2013.01)

(58) Field of Classification Search
CPC .. A47G 19/2266; B65D 15/02; B65D 1/0207; B65D 47/12; B65D 47/06; B67D 3/00; B67D 3/0045
USPC ..... 206/459.5; 215/389
See application file for complete search history.

(56) References Cited

U.S. PATENT DOCUMENTS 2,662,670 A * 12/1953 Voight ..... B65D 47/32 141/309
2,969,168 A * 1/1961 Newby ..... B65D 47/247 222/498
2,998,893 A * 9/1961 Thomas ..... B67D 3/00 215/228
3,861,955 A 1/1975 Lemelson
(Continued)

FOREIGN PATENT DOCUMENTS

DE 212010000110 U1 4/2012
DE 102010052750 A1 5/2012
(Continued)

OTHER PUBLICATIONS

EPO Office Action, Applicant's co-pending European application No. EP 13826936.0, dated Mar. 10, 2017.
(Continued)

*Primary Examiner* — Anthony D Stashick
*Assistant Examiner* — James M Van Buskirk
(74) *Attorney, Agent, or Firm* — Colby Nipper PLLC

(57) ABSTRACT

A glass neck for attachment to a container of a material other than glass is described. The glass neck comprises a wall defining a passageway having a first end and a second end, container-attachment means being provided at the first end and the second end defining a glass rim.

15 Claims, 4 Drawing Sheets

(56) References Cited

U.S. PATENT DOCUMENTS

| | | | | |
|---|---|---|---|---|
| 3,863,817 | A * | 2/1975 | Speaker | B65D 47/06 222/530 |
| 4,800,933 | A * | 1/1989 | Moore | B25B 27/0042 141/329 |
| 5,863,964 | A * | 1/1999 | Teumac | A47J 41/00 215/230 |
| 9,457,927 | B2 * | 10/2016 | Kenworthy | B65D 1/04 |
| 2009/0114615 | A1 * | 5/2009 | Joubert | B65D 23/085 215/227 |
| 2010/0126957 | A1 * | 5/2010 | DiGaetano, Jr. | B01F 3/12 215/390 |
| 2014/0190923 | A1 * | 7/2014 | Alpern | B65D 23/00 215/40 |
| 2014/0262897 | A1 * | 9/2014 | Smith | B65D 23/14 206/459.1 |

FOREIGN PATENT DOCUMENTS

| | | | |
|---|---|---|---|
| EP | 2133280 | A1 | 12/2009 |
| FR | 2385651 | A1 | 10/1978 |
| WO | 2004/026595 | A1 | 4/2004 |
| WO | 2004026595 | A1 | 4/2004 |
| WO | 2012/143955 | A1 | 10/2012 |

OTHER PUBLICATIONS

IP Australia Examination Report, Applicant's co-pending Australian application No. 2013366064, dated Feb. 23, 2017.
International Search Report and Written Opinion on International Application PCT/GB2013/053414, dated Apr. 14, 2014.
EPO Office Action dated Jul. 27, 2016, Applicant's co-pending European application No. EP 13826936.0.

* cited by examiner

CONTAINER AND ATTACHMENTS THEREFOR

FIELD OF THE INVENTION

This invention relates to containers, such as bottles, and to attachments for containers.

BACKGROUND OF THE INVENTION

Beverages are often packaged for sale in bottles. Glass bottles are often used, especially for alcoholic beverages. Glass bottles have a number of advantages over plastic bottles, including the fact that they are less permeable to gases, usually carbon dioxide in carbonated beverages, thus providing a better storage medium for beverages. Ergonomically they may be preferable to consumers of beverages, especially consumers of beer and the like in social settings such as public houses, bars, night clubs, etc. They provide a pleasing oral tactile feeling to the consumer, much more than a plastic bottle does.

The main drawback of glass bottles in such social settings is the possibility of their use as a weapon. A glass bottle can make a formidable weapon, both as a club-like implement and if smashed can lead to a hazardous shard forming that can be used to cut or maim. The possibility may be increased with consumers of alcoholic beverages who may do so to excess, leading to possible violent confrontations.

Even if not used as weaponry, the mere accidental dropping of a bottle can lead to hazardous broken glass being strewn over a floor, potentially causing injury to persons in the vicinity.

Use of plastic bottles overcomes these disadvantages, but does not provide the same tactile pleasure for the drinker.

SUMMARY OF THE INVENTION

According to a first aspect of the present invention there is provided a container comprising a body of a material other than glass, and a glass rim.

In at least one embodiment of the invention providing a container with a glass rim improves the experience of the customer when drinking from the container and provides a container which is less threatening and dangerous than a glass bottle.

The body may comprise a storage part including a reservoir for a liquid, and a neck part.

The body neck part may include the rim, the rim defining an aperture through which the liquid is accessed The body neck part aperture may be surrounded by the rim.

The neck part may include a material other than glass portion and a glass portion, the glass portion defining the rim.

The glass portion may be attached to the material other than glass portion.

In alternative embodiments, the body may comprise a storage vessel, the vessel being attached to a glass neck part, the glass neck part defining the rim.

The body may be made from a nonrigid material.

In preferred embodiments, the body is a plastic bottle.

The body may be made from a flexible material.

The body may define a gripping section.

The gripping section may be provided to permit the container to be gripped in a preferred location.

The gripping section may be substantially insulated from the body storage part. Such an arrangement permits the fluid contained in the body storage part to be insulated from the heat of the user's hand improving the drinking experience of a cold liquid.

The body may define stiffening means to give the body a tactile rigidity. Such an arrangement permits the user to experience a stiffer, more glass like experience when holding the container.

The stiffening means may be localised on the body.

The stiffening means may be positioned on a container gripping section.

The stiffening means may define the container gripping section. By restricting the stiffening means to the gripping section, the container remains substantially flexible, giving the impression of being more rigid than it actually is.

The stiffening means may be insulated.

The stiffening means may be frangible. Frangible stiffening means may be adapted to break if the container is used as a weapon The stiffening means may be defined by an internal body surface.

The stiffening means may extend into the storage part reservoir.

The stiffening means may be temperature controllable.

Particularly the stiffening means may be adapted to be chilled.

In some embodiments the container further comprises an interface between a material other than glass section and a glass section.

The material other than glass section may be releasably attached to the glass section.

The material other than glass section may be fixedly attached to the glass section.

The material other than glass section and the glass section may be attached by means of cooperating formations such as interfitting screw threads, by means of an interference fit, or by means of an adhesive, for example.

The container may comprise data collection means. Data collection means may be provided to gather information concerning the, for example, geographical location of the container.

The container may comprise display means. The display means may be adapted to display advertising or information about the container contents such as temperature or time since opening. Alternatively or additionally, the display means may be adapted to display information concerning the owner of the drink.

The display means may be passive. The display means may be adapted to receive print advertising.

The display means may be active. The active display means may be an LCD display, for example.

According to a second aspect of the present invention there is provided a glass neck for attachment to a container of a material other than glass, the glass neck comprising a wall defining a passageway having a first end and a second end, container-attachment means being provided at the first end and the second end defining a glass rim.

The glass neck may be of a generally cylindrical or frusto-conical form.

The container-attachment means may comprise an internal screw thread for cooperation with a corresponding screw thread formed externally on the neck of a bottle or may comprise a groove or detent for cooperation with a corresponding formation on the neck of a bottle.

In certain forms of the glass neck, the second end is formed to comprise a closure-attachment means which may comprise, for example, an external screw thread for engaging an internally screw-threaded cap, or an external lip or flange for receiving a crown cork.

The glass neck may include closure means. Closure means may be provided to allow contents of a container to which the glass neck is attached to pass through the glass neck but inhibit the introduction of external liquids and solids into the container through the glass neck. Such an arrangement prevents tampering with the contents of the container to which the glass neck is attached.

The closure means may be automatic.

The closure means may be manual.

The glass neck may comprise a first portion and a second portion.

The closure means may be actuable by attaching the first portion to the second portion.

Alternatively, the closure means may be actuable by removing the first portion from the second portion.

According to a third aspect the present invention there is provided a sleeve for attaching to a container of material other than glass, the sleeve comprising a body portion and the neck portion, the body portion being adapted to receive the container, the container being attached to the sleeve such that fluid communication exists between container and the neck portion, wherein the neck portion defines a glass rim.

In some embodiments, providing a sleeve which can receive a container containing a liquid allows for the container to be made from a variety of potentially non-rigid materials.

The sleeve may be adapted to receive, for example, a flexible container. The flexible container may be a waxed cardboard or flexible bag container.

BRIEF DESCRIPTION OF THE DRAWINGS

Embodiments of the invention will now be described, by way of example, with reference to the drawings, in which.

DETAILED DESCRIPTION OF THE DRAWINGS

Figure 1:
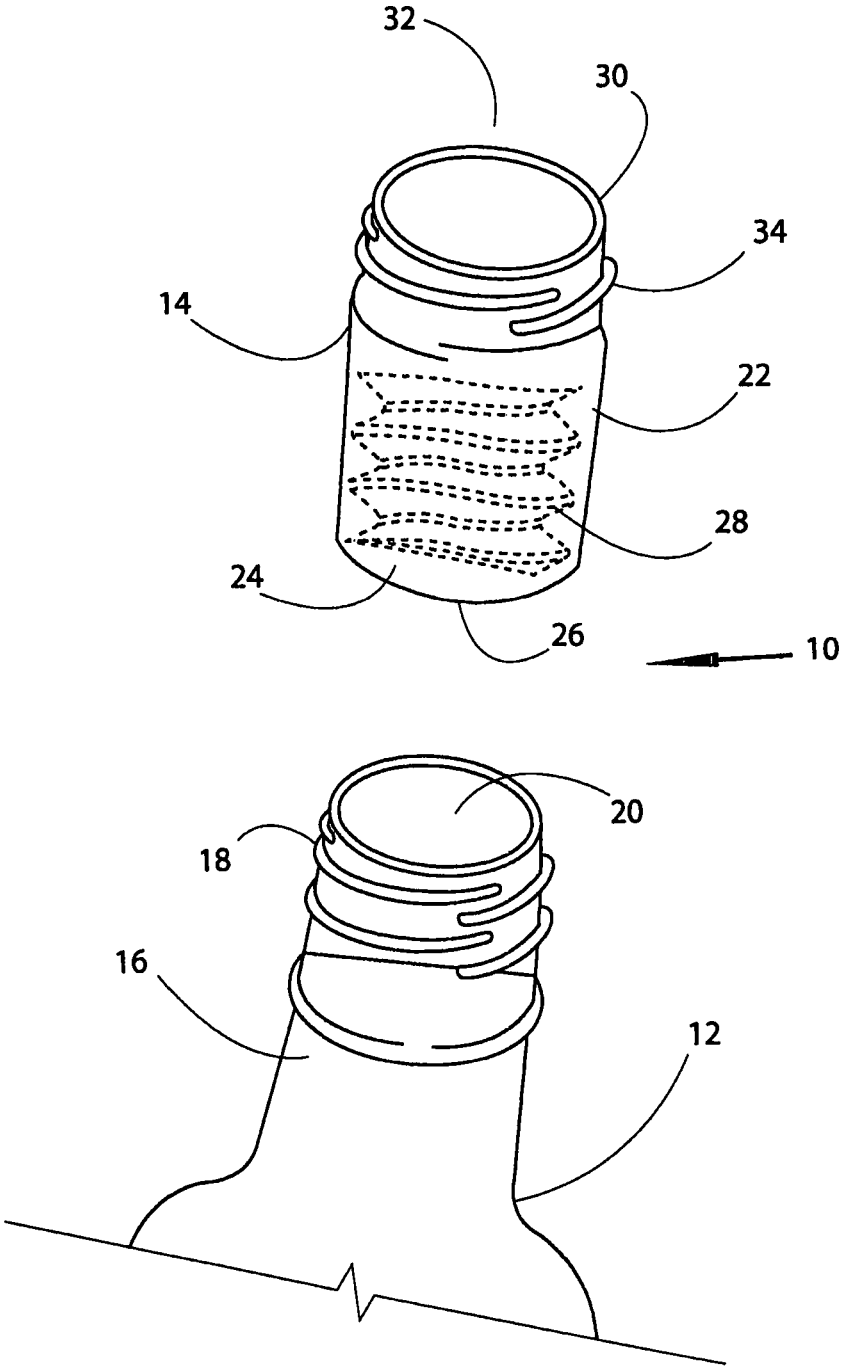
FIG. 1 is a perspective view of a bottle and attachment neck embodying the present invention.
Figure 2:
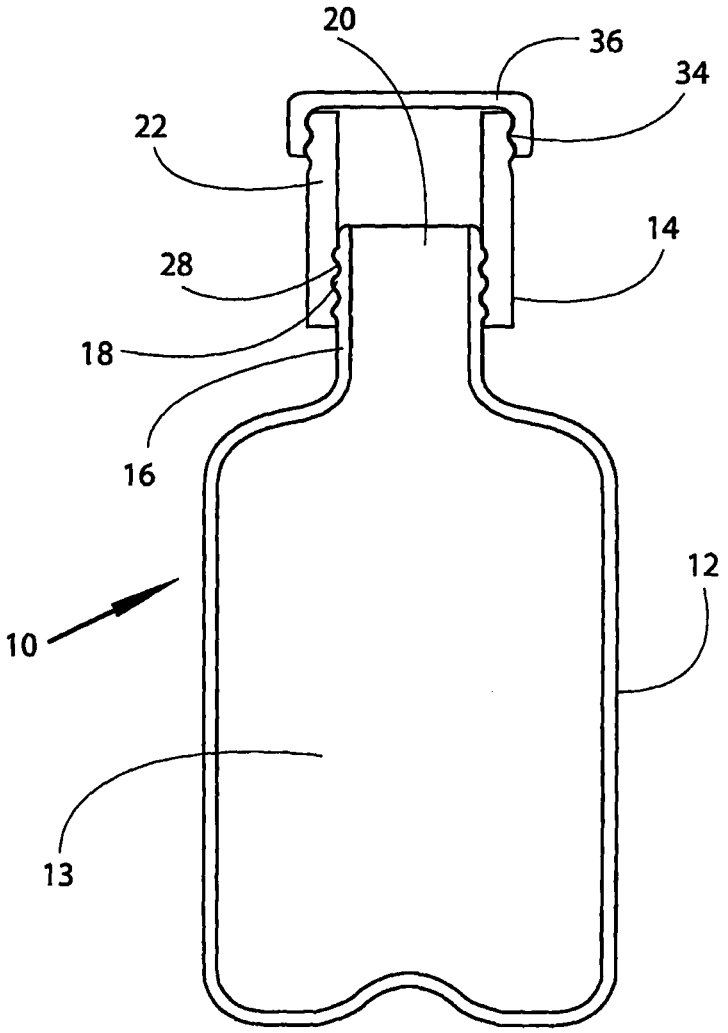
FIG. 2 is a cross-sectional side view of the bottle and attachment neck of FIG. 1.

Referring to FIGS. 1 and 2, a container 10 comprises a plastic body 12 and a glass neck 14. The plastic body 12 in this embodiment is a normal plastic bottle made from PET, HDPE or any other suitable material. The plastic body 12 includes a reservoir 13 for storing liquid, such as a beverage. The plastic body 12 includes a plastic neck portion 16.

One end of the plastic neck portion 16 is formed as a plastic external threaded portion 18 which surrounds an aperture 20 through which the contents of the plastic body 12 may be filled or drained.

The glass neck 14 comprises a generally cylindrical body portion 22. A bottle attachment means 24 is provided at a first end 26 of the glass neck 14. The bottle attachment means, in this embodiment, comprises an internal threaded portion 28 which is co-operable with the plastic external threaded portion 18.

A closure attachment means 30 is provided at a second end 32 of the glass neck 14. The closure attachment means 30 comprises an external threaded portion 34 which is co-operable with a closure such as a cap 36 (FIG. 2) having a suitable internal thread.

The container 10 is formed by screwing the glass neck 14 onto the plastic body 12. This operation may be carried out mechanically in a suitable bottling which also fills the container with a suitable liquid such as a beverage. Alternatively, this operation may be carried out on an ad hoc basis, such as a bartender screwing the glass neck 14 onto the plastic body 12 when a patron orders a beverage.

Figure 3:
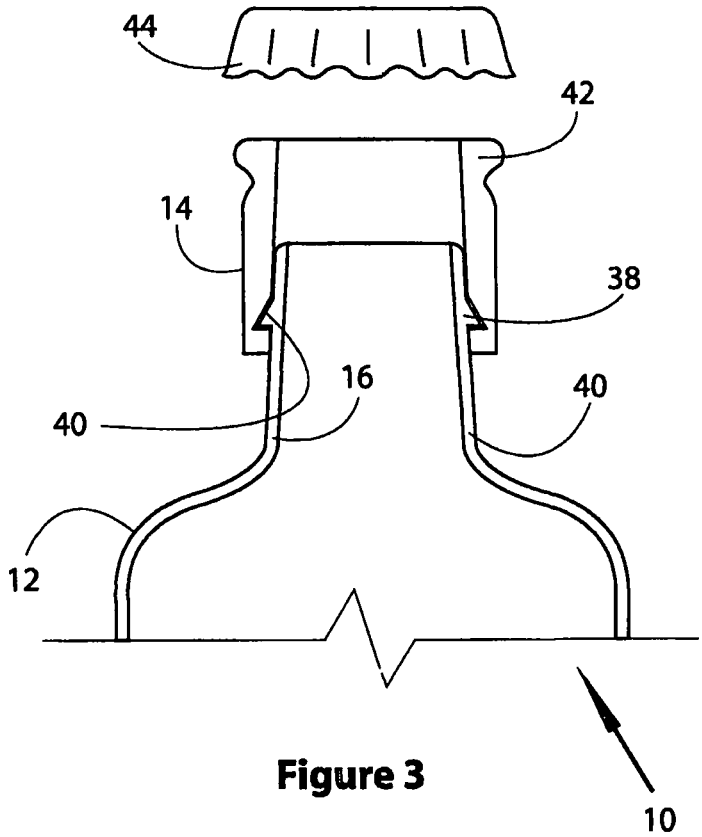
FIGS. 3-5 are cross-sectional views of further embodiments.
Figure 4:
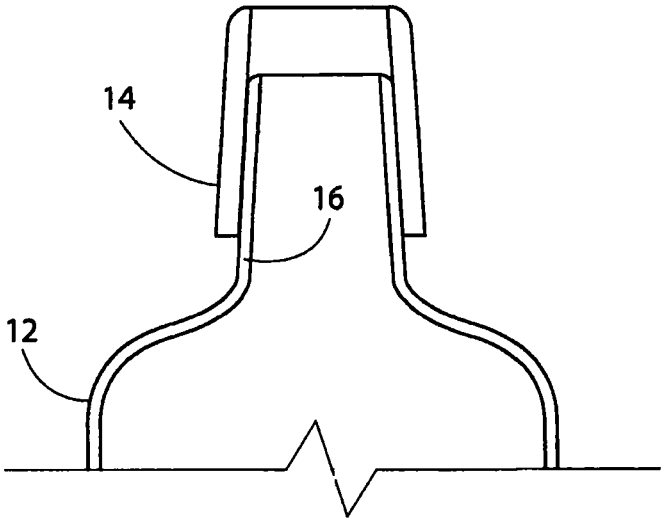
Figure 5:
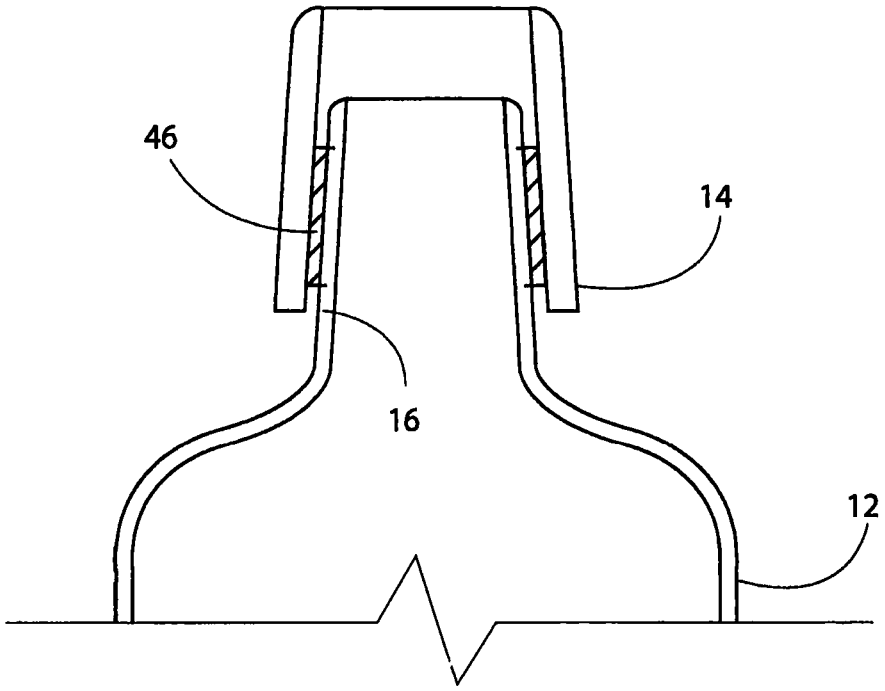

FIGS. 3 to 5 show modifications of the foregoing embodiment. Like parts are denoted by like reference numerals.

In FIG. 3, the plastic neck portion 16 is formed with an annular detent 38 which engages in a snap-fit manner with an internal groove 40 in the glass neck 14. The closure attachment means is in the form of a rim 42 for receiving a crown cork 44.

FIG. 4 shows an embodiment in which the plastic neck portion 16 has a frusto-conical form and the glass neck 14 has a matching form and engages by a friction fit. FIG. 4 also illustrates the option of the closure attachment means being omitted, the upper end of the glass neck 14 forming a simple rim; this may be suitable for ad hoc use at the point of consumption.

FIG. 5 shows an arrangement in which a sleeve 46 of rubber or other elastomeric material is interposed between the plastic neck portion 16 and the glass neck 14 to provide frictional engagement. The sleeve 46 could be replaced by adhesive.

Although a container in the form of a plastic bottle is preferred, the invention may be applied to other forms of container, for example a cardboard or cardboard/foil composite carton, a foil sachet, or a plastic bladder.

Other modifications to the foregoing embodiments may be made within the scope of the invention as defined in the claims.

The invention claimed is:

1. A glass neck for attachment to a container of a material comprising plastic or aluminum, said container comprising a neck of the material, the glass neck being of frusto-conical form and comprising a wall defining a passageway through the glass neck having a first end and a second end, wherein the first end of the passageway is configured so that the neck of the material of the container may be inserted into the passageway and the passageway engages the neck of the material of the container by a friction fit, and the second end defining a glass rim.

2. The glass neck according to claim 1, wherein the glass neck further comprises a material disposed within the passageway at the first end for providing the friction fit.

3. The glass neck according to claim 1, wherein the friction fit is facilitated by a groove or detent at the first end of the passageway.

4. The glass neck according to claim 1, wherein the second end is formed to comprise a closure-attachment means.

5. The glass neck according to claim 4, wherein the closure-attachment means comprises an external screw thread for engaging an internally screw-threaded cap.

6. The glass neck according to claim 4, wherein the closure-attachment means comprises an external lip or flange for receiving a crown cork.

7. The glass neck according to claim 1, wherein the glass neck includes closure means to prevent a liquid contained in the container from escaping through the passageway when the glass neck is attached to the container.

8. The glass neck according to claim 7, wherein the closure means is automatic.

9. The glass neck according to claim 7, wherein the closure means is manual.

10. The glass neck according to claim 7, wherein, the closure means comprises a first portion and a second portion.

11. The glass neck according to claim 10 wherein the closure means is actuable by attaching the first portion to the second portion.

12. The glass neck according to claim 10, wherein the closure means is actuable by removing the first portion from the second portion.

13. A multi-part container comprising:

a body of a material comprising plastic or aluminum, the body comprising a storage part including a reservoir for a liquid and a neck attachment portion; and a glass neck of generally frusto-conical form defining an aperture through which the liquid is accessed, wherein the glass neck is attached to the body such that the neck attachment portion of the body that is made of the material comprising plastic or aluminum is disposed within the aperture of the glass neck.

14. The container of claim 13, wherein the body made of the material comprising plastic or aluminum defines a gripping section, wherein the gripping section is provided to permit the container to be gripped in a preferred location.

15. The container of claim 13, wherein the body made of the material comprising plastic or aluminum defines stiffening means defined by an internal body surface to give the body made of the material comprising plastic or aluminum a tactile rigidity, wherein the stiffening means are insulated, and wherein the stiffening means are adapted to be chilled.

* * * * *